United States Patent [19]

Potter

[11] 4,293,841

[45] Oct. 6, 1981

[54] PEDESTRIAN TRAFFIC CONTROL SYSTEM

[75] Inventor: Thomas R. Potter, Los Alamitos, Calif.

[73] Assignee: Detector Systems, Inc., Cypress, Calif.

[21] Appl. No.: 930,576

[22] Filed: Aug. 3, 1978

[51] Int. Cl.[3] ..... G08G 1/09; G09F 11/28; G09F 11/16; G08B 21/00

[52] U.S. Cl. ..... 340/44; 40/465; 40/467; 40/472; 116/63 R; 340/124; 340/378.5; 340/810; 340/663; 250/548

[58] Field of Search ..... 340/44, 31 R, 103, 119, 340/107, 124, 125, 129, 143, 145, 373, 783, 810, 809, 378.3, 41 R, 378.5, 378.6, 46, 210, 332, 43, 650, 652, 663; 40/465, 467, 514, 577, 472, 471, 553, 558, 559; 116/63 R, 42, 278; 250/548; 307/64, 66; 361/92

[56] References Cited

U.S. PATENT DOCUMENTS

| | | | |
|---|---|---|---|
| 2,514,049 | 7/1950 | Graham | 40/553 |
| 2,724,100 | 11/1955 | Hastings | 340/43 |
| 3,564,495 | 2/1971 | Gould | 340/44 |
| 3,703,778 | 11/1972 | Pfleger | 40/472 |
| 3,753,001 | 8/1973 | Hiroshima et al. | 307/64 |
| 3,822,493 | 7/1974 | Maley | 340/378.3 |
| 4,021,793 | 5/1977 | Hill et al. | 340/41 R |

FOREIGN PATENT DOCUMENTS

| | | | |
|---|---|---|---|
| 415434 | 8/1934 | United Kingdom | 340/44 |

*Primary Examiner*—James J. Groody
*Attorney, Agent, or Firm*—Townsend and Townsend

[57] ABSTRACT

The pedestrian traffic control system of this invention utilizes an endless belt to successively display visible painted WALK, DONT START, and DONT WALK signs in a window of a display unit. The control unit may be employed with an ordinary three-state power system of the type that now operates flashing neon signs, but has the advantage that electric power operates the signs only when a sign is being moved into display position. Three distinct WALK, DONT START, and DONT WALK signs are used thereby avoiding the ambiguity of present systems in which a flashing DONT WALK sign cautions the pedestrian not to start, but to continue on his way. The movement of the endless belt is controlled by detecting markers, such as perforations, on the endless belt, thus assuring proper registration of the signs in display position. Electrical energy that becomes stored while the sign is energized drives the sign to display the DONT WALK sign, if the power fails. The invention may be applied to other types of endless signs and with other types of control means that move synchronously with the endless sign.

18 Claims, 12 Drawing Figures

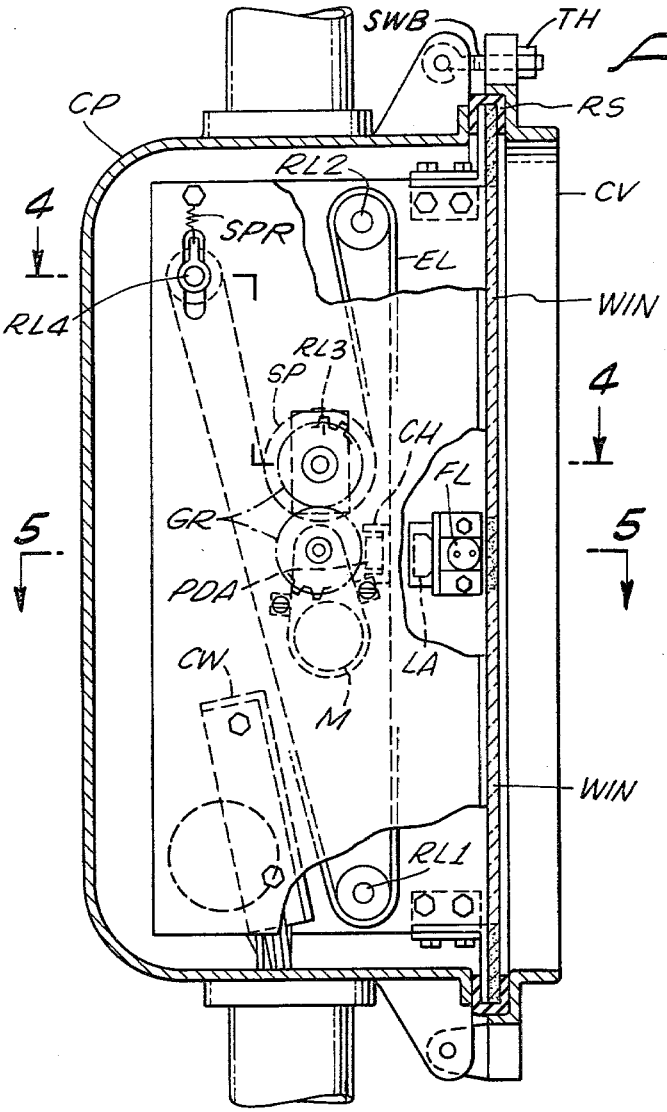
FIG. 3.
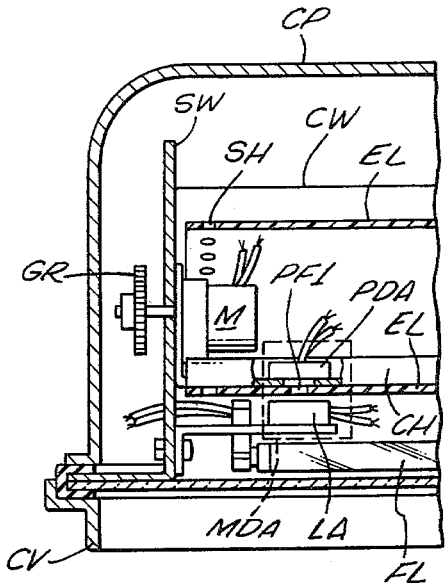
FIG. 5.
FIG. 4.
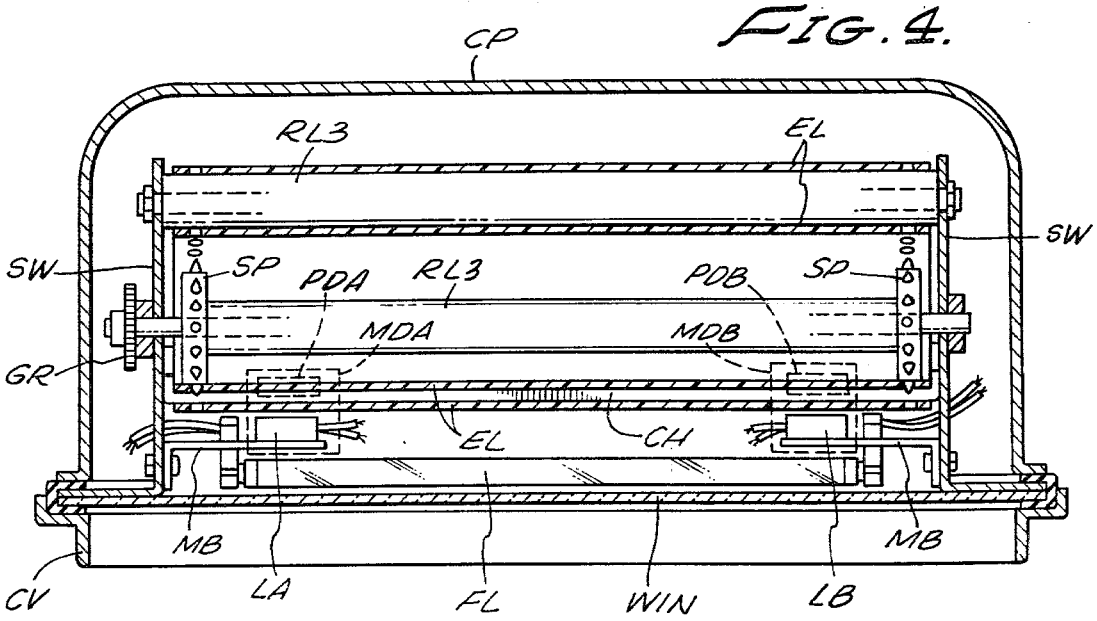

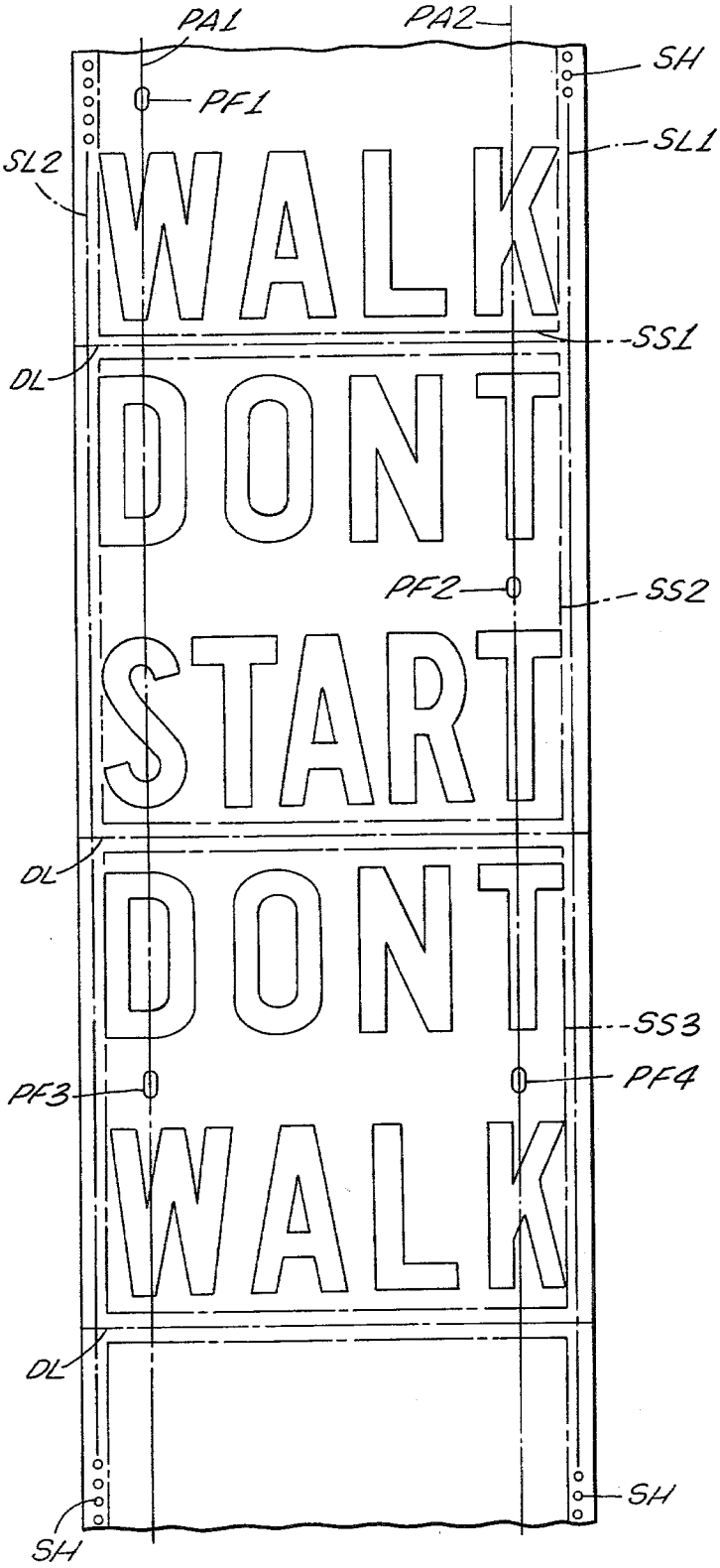
FIG. 7.
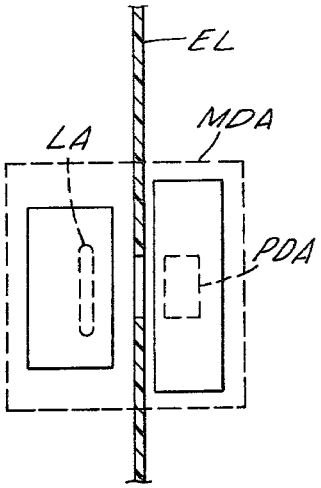
FIG. 8.
| FIG. 9A. | FIG 9B. |
|---|---|
FIG. 9.

PEDESTRIAN TRAFFIC CONTROL SYSTEM

INTRODUCTION

This invention relates to an improved visual system for controlling pedestrian traffic at a crosswalk. The invention relates particularly to an improved automatic signal display unit that selectively displays one at a time "WALK", "DONT START", and "DONT WALK" signs with far less consumption of electric energy than those commonly in use, and with a mechanism that automatically places the signal in a "DONT WALK" condition in the event of power failure. The invention also relates particularly to a signal unit that is adapted to utilize controllers of pedestrian traffic control systems now in use, thereby minimizing the expense of replacement of automatic signal units now commonly in use. In this way the benefits of this invention may be obtained at minimum cost.

BACKGROUND

Numerous traffic control systems are now in use. In the most common type, four or eight signal standards are erected at the four corners of an intersection of two mutually crossing streets. Each of these standards has a number of traffic light signal units mounted on it to indicate on which street drivers of vehicles have the right of way for crossing the other street. More particularly, the light signal unit typically has three lights, a "GO" condition, a caution, or "SLOW" down, condition, and a "STOP" condition respectively. An automatic controller mounted at the intersection, controls these traffic light units. The controller also normally includes means for operating the street lights at the intersection so that they are energized to provide illumination at night and are deenergized to reduce power consumption during the day. Some of such traffic signals operate automatically, constantly cycling through a "GO" condition, a "SLOW", that is a slow down, or caution, condition, or a "STOP" condition sequentially over and over. Other systems are traffic actuated, that is, they respond automatically to the flow of traffic so as to provide longer, and/or more frequent, crossing periods in the direction in which traffic flow is heavy, and shorter, and/or less frequent, crossing periods in the direction in which traffic flow is low.

Traffic signals are also provided sometimes at points between successive intersections, such as in the middle of a block. And these traffic conditions are set in a "GO" condition for traffic flowing on the street, but may be actuated by a switch operated by a pedestrian to bring the flow of traffic to a halt and to permit him to cross safely.

In all such systems, it is common to provide additional signal for indicating to pedestrians whether it is safe for them to cross the street. These signals usually include a "WALK" sign, and a "DONT WALK" sign. In addition, the controller not only actuates the "WALK" and "DONT WALK" signs in synchronism with the operation of the traffic signals, but also provide intermittent power to cause the "DONT WALK" sign to flash intermittently during a period when it is dangerous to start. Such danger arises because the "WALK" interval, being finite, may terminate while a person starting to cross the street does not arrive at the other side before the "GO" signal becomes illuminated to allow traffic to flow on the street that he is crossing. The controller not only operates the traffic signals and the overhead street lighting, but also provides the signals for causing the "WALK" and "DONT WALK" signs to be actuated in synchronism therewith. Thus, the "WALK" sign is energized to permit pedestrians to walk across the street in the direction of flow of traffic during a particular period when it is relatively safe to do so, and a "DONT WALK" sign to warn the pedestrian that it would be very dangerous to cross the street. The intervals of energization of the "WALK" and "DONT WALK" signals are not usually the same as the intervals of energization for the "GO" and "STOP" signals. Nevertheless, they are synchronized therewith for the security of pedestrians and drivers of vehicles.

Such "WALK" and "DONT WALK" signals are commonly in the form of neon tubes. These tubes emit green or white light during the "WALK" period and red light during the "DONT WALK" period. They also may be in the form of printed signs that are illuminated by incandescent lights.

This invention will be described with reference to its improvements and advantages over the present pedestrian traffic control systems of the type that employ tubular gaseous discharge lamps, commonly called neon lights even though there may be no neon sign involved, to indicate the "WALK" and "DONT WALK" conditions, and particularly with reference to such a system in which pushbuttons are provided on the standards for actuating the pedestrian traffic control system.

In the pedestrian actuated traffic control systems, switches are mounted on the signal standards which can be operated by pedestrians to actuate systems. In this way, the pedestrian traffic control system is actuated only when needed.

GENERAL STATEMENT

In this invention, an improved pedestrian traffic control unit is employed in place of pedestrian traffic control unit commonly in use. The control units of this invention, in effect, are substituted for old units and make use of the electric controllers employed in those prior units. An important feature of the present invention lies in the use of an endless loop, or belt, which bears a WALK, a DONT START, and a DONT WALK signs printed on or otherwise embodied therein, together with a control system actuated by the usual traffic-sign controller to advance each of the three signs to a display position where it can be viewed by the affected pedestrians in synchronism with the operation of the traffic signs.

The signs of this invention require no illumination during the daytime, but are provided with a fluorescent light which is actuated in synchronism with the overhead street lights to provide auxiliary illumination at night.

The neon-light pedestrian traffic control system normally requires continuous energization at a rate of 100 to 150 watts both night and day. In a practical embodiment of this invention, the endless sign is driven by a small motor that is actuated intermittently to drive the sign from one of its indicating positions to another, and which requires on the average, only about 3 watts of power. In addition, in this invention, the fluorescent bulb needed for night illumination of the sign consumes only about 8 watts and at that is actuated less than half the time. While the fluorescent bulb is supplied power through a ballast which results in some loss of power, the total power requirement of the pedestrian control signal unit of this invention, runs approximately 3 watts during the daytime, and something under 20 watts at night. It is thus seen that this invention results in a large saving of electrical power. The magnitude of this saving can be appreciated when it is recognized that in a large municipality, having about 35,000 street intersections utilizing eight pedestrian signs per intersection, at current power rates, the saving in the power bill may amount to about $15,000,000.00 per year. This invention would also be capable of being maintained at lower cost, including costs of replacing light units. There is therefore a great economic need for this invention and the need will become greater in the years ahead when the cost of electrical energy increases.

There is another important advantage of this invention. In the present systems, in daylight hours when the power fails, the luminous electric signs no longer emit light, thus becoming invisible, failing to warn pedestrians of danger. This invention overcomes that defect by virtue of the fact that while the system is working, electrical energy is stored in a capacitor and by the inclusion of a fail-safe circuit which operates when the power from the controller fails, to drive the endless sign to its DONT WALK condition, if not already there. The sign, of course, is visible in daylight to caution the pedestrian, and at night it is also often visible because of the quantity of ambient light present from street signs or otherwise. At night, the need for a DONT WALK caution is less than in the daylight because normally any dangerous traffic will itself provide, through its headlights, a warning to the pedestrian to be cautious.

In traffic controllers currently in use, the controller includes a power source that provides electrical power successively in each of three different states. In one state, the WALK sign is energized to indicate a WALK condition. In a second state, the pedestrian sign is energized to indicate a DONT WALK condition. And in a third state, the DONT WALK light is energized intermittently at one second intervals to caution the pedestrian not to start walking. In the best embodiment of this invention, the pedestrian traffic signal unit is designed to respond to such a three-state power source to drive the endless sign of this invention to a corresponding stationary condition indicating more clearly whether the pedestrian may walk, should not start, or should not walk across the street.

The present system, which involves intermittent energization of the DONT WALK sign is often confusing to pedestrians, especially inexperienced users of pedestrian control signals, who may be confused by such a sign when they have already started to walk across the street and have not yet reached the other side. This difficulty is eliminated by means of the present invention by virtue of the fact that three different verbal messages, carrying distinctly different information understandable to the ordinary reader, are displayed one at a time. Thus, the DONT START signal of this invention is clearly different than a conventional DONT WALK signal that is flashing. The use of such three signs can therefore reduce pedestrian fright and possibly even reduce serious accidents.

As a further aid in enhancing the convenience and safety of the pedestrian signal system of this invention, the WALK section of the endless sign is colored white, the DONT START section of the sign is colored yellow, and the DONT WALK section of the sign is colored red, these colors thus being coordinated with the colors familiar to most drivers of vehicles, and pedestrians.

In the best mode of practicing the invention now contemplated, the movement of the endless sign is controlled by the control unit that operates the traffic signals and supplies three-state power. With such a system, the time intervals during which the traffic pedestrian sign remains in one of its three conditions is determined by settings of the controller. It will be understood, however, that the invention may be practiced in other ways, such as by providing a mechanical, or electrical, programmer which is programmed to move the pedestrian sign automatically from one of its indicator positions to another at prescribed times after a predetermined event has occured, such as pushing of the pedestrian button. Such an alternative form of the invention would be adapted particularly for use where pedestrian traffic is controlled crossing a path that does not carry motor vehicle traffic and hence does not require the use of standard vehicle traffic signals. The invention may also be used by suitable modification to provide more than three messages for pedestrians and may make use of electrical power that has more than three states.

THE DRAWINGS

The foregoing and other features of this invention will become apparent from a reading of the following description taken in connection with the accompanying drawings, wherein:

FIG. 3 is a cross-sectional view of the sign display unit taken through the plane 3—3 of FIG. 2;

FIG. 4 is a cross-sectional view of the sign display taken through the plane 4—4 of FIG. 3;

FIG. 5 is a sectional view of a part of the pedestrian control unit taken on the plane 5—5 of FIG. 3;

FIG. 7 is a plan view of an endless belt employed in this invention;

FIG. 8 is a schematic view showing a mark detector in relation to an endless belt;

FIG. 9 is a figure that shows how

FIGS. 9A and 9B are schematic diagrams of the controller; and

GENERAL DESCRIPTION OF THE INVENTION

Figure 1:
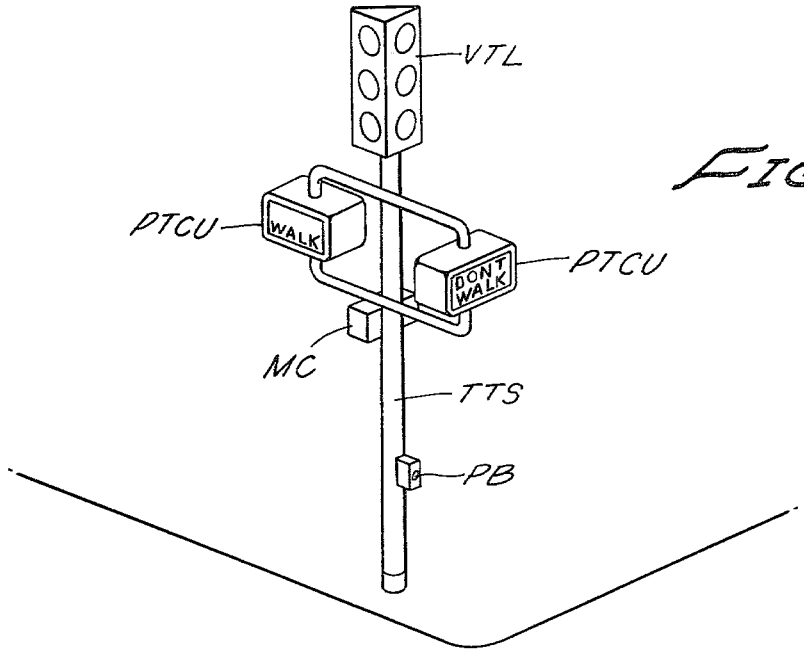
FIG. 1 is a perspective view of an intersection at which a pedestrian traffic control system of this invention is installed.
Figure 6:
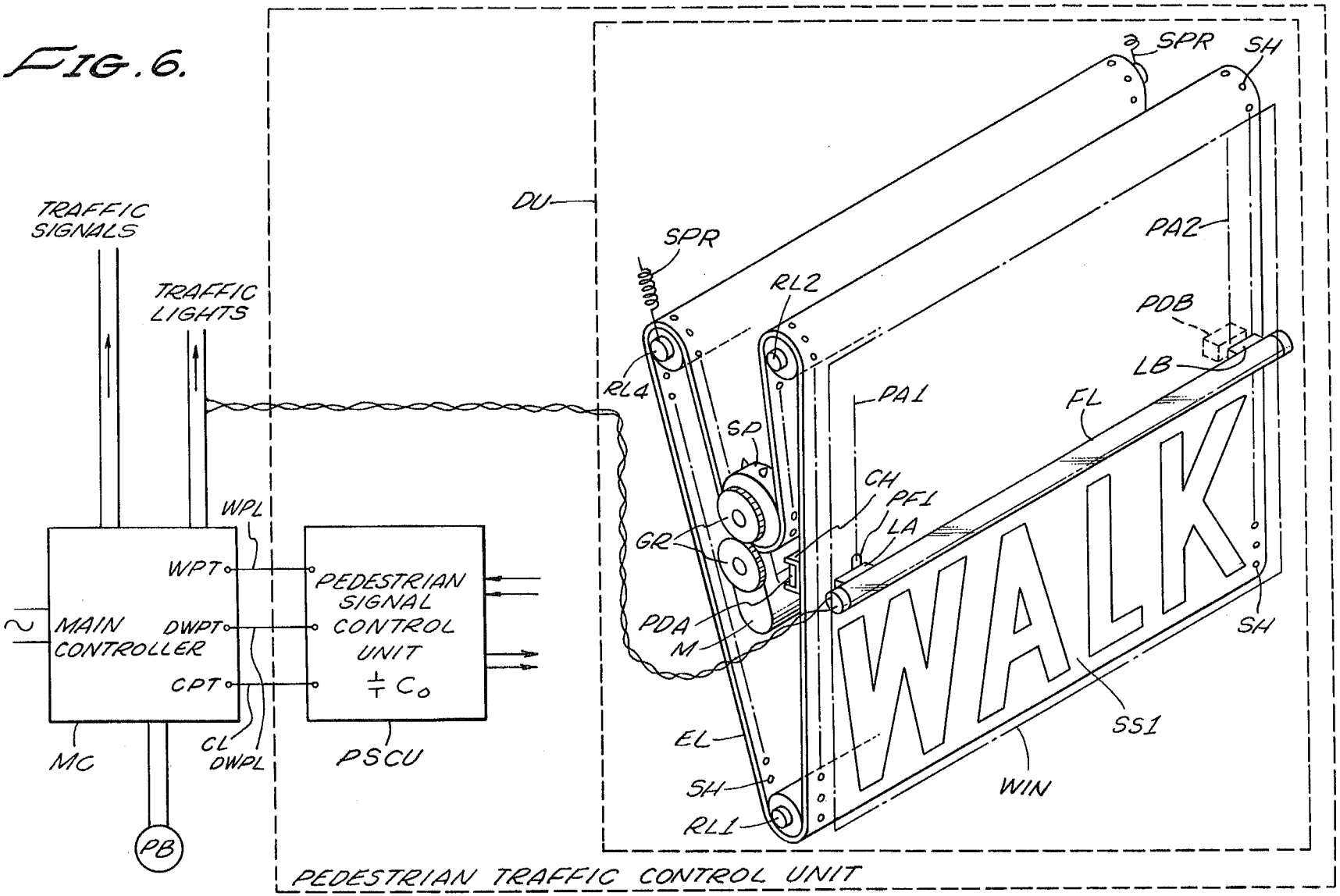
FIG. 6 is a schematic view partly in perspective of the pedestrian traffic control system of this invention.

The general nature of this invention may be understood by reference to FIGS. 1 and 6. The pedestrian traffic control system of this invention includes a main controller MC and a pedestrian traffic control unit PTCU that are mounted on a traffic signal standard, or lamp post, TTS at one corner of an intersection. In the example illustrated, two such pedestrian traffic control units PTCU are mounted on the standard. Each display unit is mounted to be viewed by pedestrians on opposite sides of the two intersecting streets that form the corner at which the standard in question is mounted. Similar units are mounted at the other three corners at the intersection, but they lack separate master controllers. The pedestrian traffic control units at all four corners are connected to a single main controller MC that coordinates the operation of all eight units.

As more fully explained hereinafter, the main controller provides the three-state AC power. And this three-state power is supplied to the two pedestrian traffic control units PTCU located at each of the respective corners of the intersection. The three-state power provides power in three distinct conditions successively at different times corresponding respectively to WALK, DONT START, and DONT WALK conditions to each controller so as to coordinate the actions of the eight controllers. The state of the power being applied at any one time by a pedestrian signal control unit is sometimes referred to as its command state.

To simplify the description, the invention will sometimes be illustrated in connection with a traffic control system which is automatically operated only when actuated by pressing a pushbutton PB and sometimes in connection with a system in which operation is actuated by the traffic flowing on two intersecting streets. Both kinds of such automatic traffic control systems are well known. One such type of traffic-actuated system employs sensing coils mounted within the street pavement and inductively coupled magnetically to vehicles traveling on the street. Commonly, the presence of a vehicle causes a change in the resonant frequency of the circuit connected with the coil and the coils are connected to a master control unit MC at the intersection for controlling the operation of the traffic signals in response to such changes.

Also for simplicity, the invention will be illustrated in connection with a traffic control system in which the pushing of any one of the pedestrian pushbuttons PB on the four standards actuates the master controller and hence the pedestrian traffic control units PTCU at the intersection. Each of the pushbuttons actuates the control unit to operate the vehicle traffic lights VTL and the pedestrian traffic sign units in synchronism so as to control vehicle and pedestrian traffic for the safety of both.

Figure 2:
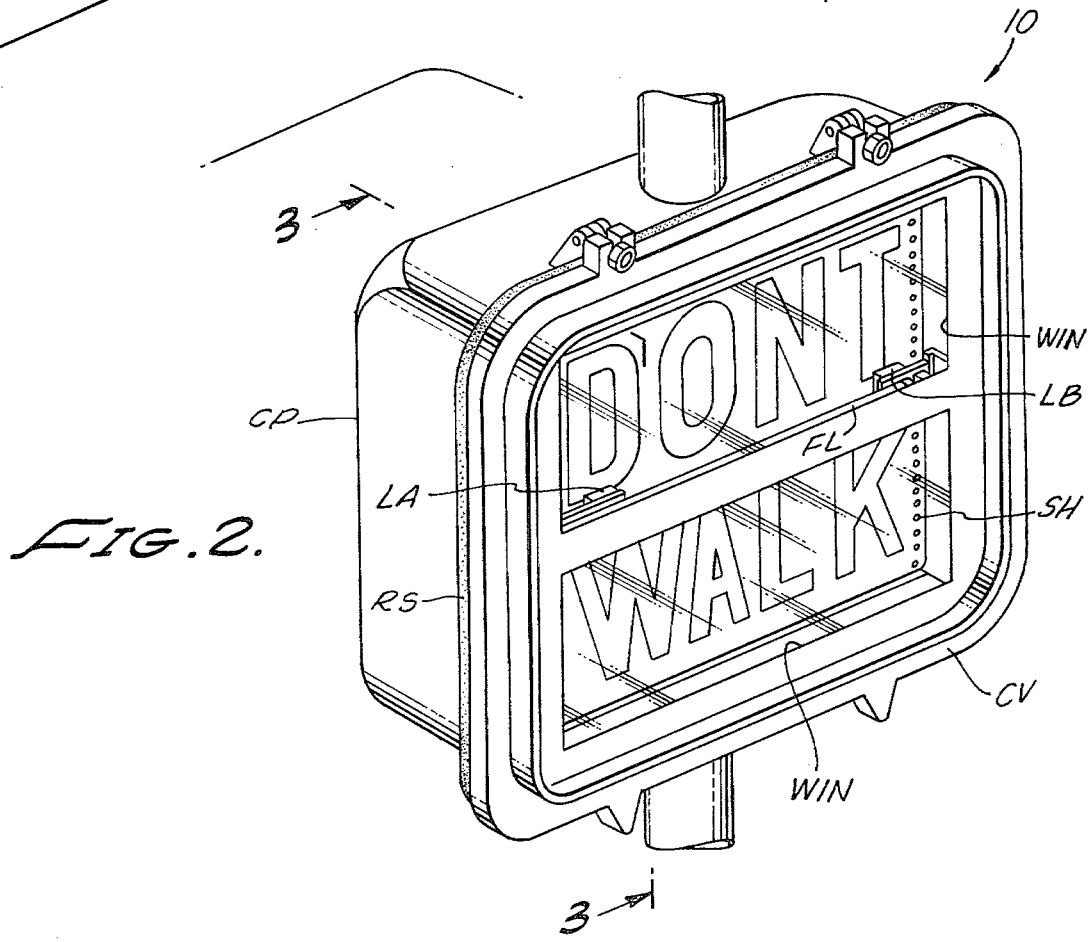
FIG. 2 is an enlarged view showing the sign display unit in perspective.

The main controller MC provides three-state signals of the type described in more detail hereinafter, and the actuation of the pushbutton operates a section of the controller to apply the three-state power to terminals WPT, DWPT, and CPT for controlling the operation of the pedestrian sign display unit 10 (FIG. 2) at all corners. Heretofore, the three-state power at those terminals had been employed to actuate pedestrian signal control units, such as those now commonly employed in which neon light are used to indicate the three conditions required to control pedestrian traffic. As viewed by the pedestrian, such prior signals may be in the form of a white neon sign that spells WALK and a pair of red neon signs that spell DONT WALK, and a third signal in the form of flashing of the pair of red signs. The flashing signal is meant to convey the DONT START idea. But as mentioned above, such a flashing sign is confusing to some pedestrians and hence is dangerous.

Sign Display General Action

Refering to FIGS. 2, 3, 4, 5, 6, and 7, the display unit DU of this invention utilizes a continuous endless sign EL having three sign sections SS1, SS2, and SS3 equally spaced thereon, together with means for positioning any one of the three signs in display position in front of a window WIN where it may be viewed by a pedestrian from the opposite side of the street. In the best embodiment of the invention now contemplated, the endless sign is in the form of a loop, or belt, which is mounted on rollers RL1, RL2, and RL3 and supported thereon under tension by means of an idler roller RL4 pulled against the loop under tension by means of a spring SPR.

The endless loop bears sprocket holes SH near opposite edges thereof for engaging sprockets SP on sprocket wheels on roller RL3, which is driven by a DC electric motor M through a suitable gear reduction unit Gr. Typically, the seed of the motor is 60 RPM and the length of the endless loop is about 3 feet, and the gear reduction ratio is set so that, in the absence of pauses in the motion of the belt, the total time elapsed for one complete revolution of the loop lies between 5 seconds and 10 seconds.

The pedestrian traffic control unit PTCU includes a local pedestrian signal control unit PSCU (See FIG. 6) that converts the three-state AC power to DC power. The DC power is employed to supply energy to the motor when required, and also to provide signals that control the energization and deenergization of the motor.

The three signs on the endless loop read, "WALK", "DONT START", and "DONT WALK", and the pedestrian signal control unit PSCU operates under the control of the three-state power and position markers PF1, PF2, PF3, and PF4 on the belt to position the three signs in display position in the display unit DU and in cooperation with the action of the main controller so as to control pedestrian traffic in a safe manner. Light-emitting diodes LA and LB that are in series with the motor M (see FIG. 9B) are energized to emit light as long as power is available for operating the motor M under control of the control signals. The pedestrian signal control unit PSCU is also connected to photosensors PDA and PDB, which are utilized, together with the light-emitting diodes LA and LB, to provide control signals that indicate whether or not the required sign section of the loop is in its display position behind the window WIN of the sign display unit.

The pedestrian signal control unit PSCU is actuated to energize the motor to drive the endless loop to the required position if the appropriate sign section of the loop is not already in display position, and to deenergize the motor to halt the motion of the loop so as to retain the desired sign section in display position when it reaches that position.

The pedestrian signal control unit PSCU includes a capacitor $C_o$ in which electrical energy is stored as long as power is supplied to the pedestrian signal control unit for any sustained period, and the local pedestrian signal control unit is designed to make that energy available to the motor M and the light-emitting diodes to drive the endless loop to the DONT WALK sign display position, if it is in any other position when the alternating current power in the main controller MC fails.

Consider the action when the loop is in a DONT WALK condition and a pedestrian pushes the pushbutton PB at the intersection. Within a fraction of a minute or so, the main controller MC operates automatically to provide three-state power at its output terminals PT1, PT2, and PT3, as in many traffic control systems now in common use. Power appears there in sequence in each of three different states. When the power is supplied in the WALK state, changes occur in the local pedestrian signal control unit that energize the motor M to advance the loop to position the WALK sign before the display window and to hold it there while the power remains in the walk state. Then, when the alternating AC power changes to the DONT START state, changes occur in the local pedestrian signal control unit that energizes the motor again to advance the loop, but this time advancing the DONT START sign to the display position and to hold it there while the AC power remains in the DONT START state. Subsequently, the state of the AC power changes to a DONT WALK condition, energizing the motor a third time, causing it to advance the loop to display position and to hold it with the DONT WALK sign section displayed in the window.

The main controller MC includes means for holding the AC power in a DONT WALK state until a pushbutton PB at the intersection is pushed again by a pedestrian. If, for some reason, a failure occurs which causes the main traffic controller to fail to spply AC power while the belt is in some position other than the DONT WALK position, the pedestrian signal control unit PSCU operates automatically to energize the motor to advance the endless loop EL to the DONT WALK condition and to hold it there indefinitely until AC power is supplied again in a different command state.

The character of the three-state AC power, the manner in which the three states are timed, and the manner in which various control signals are developed and power is applied to the motor to advance the endless loop to position its three sign sections in display position when required, are explained more fully below.

The Endless Loop

Referring to FIG. 7, the endless loop is illustrated as if cut transversely through the WALK sign section and laid out flat. The endless loop usually consists of a single continuous sheet of fabric, or plastic material, with its ends integrally joined together. The belt includes three consecutively joined sign sections SS1, SS2, and SS3 of equal length. In this figure, transverse dotted lines indicate where the sections adjoin each other.

The body of the endless loop is black. The word "WALK" is painted in white or green on the first section SS1. The words "DONT START" are painted in orange or yellow on the second section SS2. The words "DONT WALK" are painted in red on the third section SS3. Sprocket holes SH are located on paths shown in dotted lines SL1 and SL2. The paths are spaced inwardly of and are parallel to opposite edges of the endless loop approximately three-fourths of an inch. Two paths PA1 and PA2, shown in dotted lines, extend along the length of the loop on opposite sides thereof and near the respective lines of sprocket holes for bearing coded markers PF1, PF2, PF3, and PF4, that have positions thereon coordinated with the locations of the three signs SS1, SS2, and SS3, so that when these markers reach a predetermined point along its path of movement in the sign housing, the corresponding sign will be located in display position opposite the window WIN, and the other two signs will be out of view. The markers are equally spaced along the endless loop so that their positions are coorindated with the positions of the respective signs and the location of the marker detector MD. In this case, the markers lie midway between the transverse edges of the respective sign sections.

In the best embodiment of the invention illustrated, the markers are in the form of coded perforations, and each marker detector MDA and MDB includes a light-emitting diode LA or LB and photosensors PDA and PDB respectively. The diode and photosensor of each detector are located on opposite sides of the endless loop when it is mounted in operative position in the housing. In practice, there are two perforations on each path PA1 and PA2. Two perforations PF3 and PF4 are located on the respective paths PA1 and PA2 in positions corresponding to the DONT WALK sign. One perforation PF1 is located on one path PA1 at a position coordinated with the location of the WALK sign SS1. And another perforation PF2 is located on the other path PA2 in a position coordinated with the location of the DONT START sign SS2.

The endless belt of this invention may be made of mylar or other thermo-setting plastic. But the best material found so far has been a fiberglass tape supplied by Gentape Corporation of Bloomfield, N.J. For the purpose of this invention a black fiberglass-type tape having a thickness of 0.004 inch is employed. The signs are painted in their appropriate positions by applying an inorganic paint of suitable color by means of a screening process and then the painted surface is coated with a very thin film of clear nylon. The nylon coating completely encapsulates the paint protecting it from deterioration. Such an endless belt is functional for the purpose of this invention in every respect. It is free of excessive stretching or deformation or other failure over a wide temperature range from −65° to +290° F., thus rendering it suitable for use under a variety of climatic conditions. Thus this endless belt has long life, high strength, and is free from excessive deterioration due to sunlight and other environmental conditions.

In the past endless loops have been used for various purposes, together with control devices of the potentiometer type in which a circular member supporting the loop has been set in a predetermined position by means of a master-slave servo mechanism. While such an arrangement may be employed in this invention, it is subject to the difficulty that if the belt slips on the circular support, a sign will not always be presented to view through the window. But in the best form of this invention the sign that is to be displayed is registered with the window automatically, even if such slippage does occur, because the movement of the sign is controlled by means of markers of the sign itself. It is believed that this feature is new and meritorious.

Details of Mechanical Features

The pedestrian signal control unit PSCU and the display unit DU are supported on a mounting frame that is mounted within a housing that includes a stationary cup-shaped member CP and a removable cover CV.

The mounting frame has two side walls SW interlocked by a crossplate, or bulkhead, CW and other strengthening crossbars. The side walls SW are provided with means for supporting the various rollers. These means include stationary bearings for supporting the rollers RL1, RL2, and RL3 and guide slots for supporting the shaft of idler roller RL4.

A sign section of the endless belt EL that is to be displayed is supported in position opposite the display window WIN and is illuminated by sunlight or other ambient light during the daytime. A fluorescent light FL is supported on a mounting bracket MB attached to the side walls SW opposite the center of the window WIN so as to provide light for illuminating the sign section on display during the night. Power for this light is supplied by the main controller. This power is synchronized with power for street lights at the intersection and is turned on and off at the same time by the main controller MC.

Parts of the mark detector units MDA and MDB are located opposite the paths PA1 and PA2 on opposite sides of the endless belt. Each mark detector unit includes a light-emitting diode LA or LB attached to a bracket at one end or the other of the fluorescent light FL and also a photosensor unit PDA or PDB located on a support bracket CH that extends between the side walls of the support frame.

The pedestrian signal control unit PSCU is mounted on the transverse bulk head CW port wall.

The window is provided with a rubber seal that encircles the cover. The cover is hinged at the bottom to swing downwardly therefrom and is located in place by means of swivel bolts SWB and nuts. Suitable ports are provided in the wall of the cup-shaped part CP to provide for electrical connections between the pedestrian signal control unit PSCU and the main controller MC and for breathing of the cavity within the cabinet.

The rollers RL1, RL2, and RL4 are of cylindrical configuration to provide for firm support of the belt across its entire width. The drive roller RD3 may be in the form of a pair of sprocket wheels SP without providing such intermediate support.

The dimensions and shape of the frame are such that the pedestrian control and sign display unit of this invention may be mounted in cup-shaped housing members CP of conventional pedestrian control systems already in use.

The Control Signal System—General

Figure 9A:
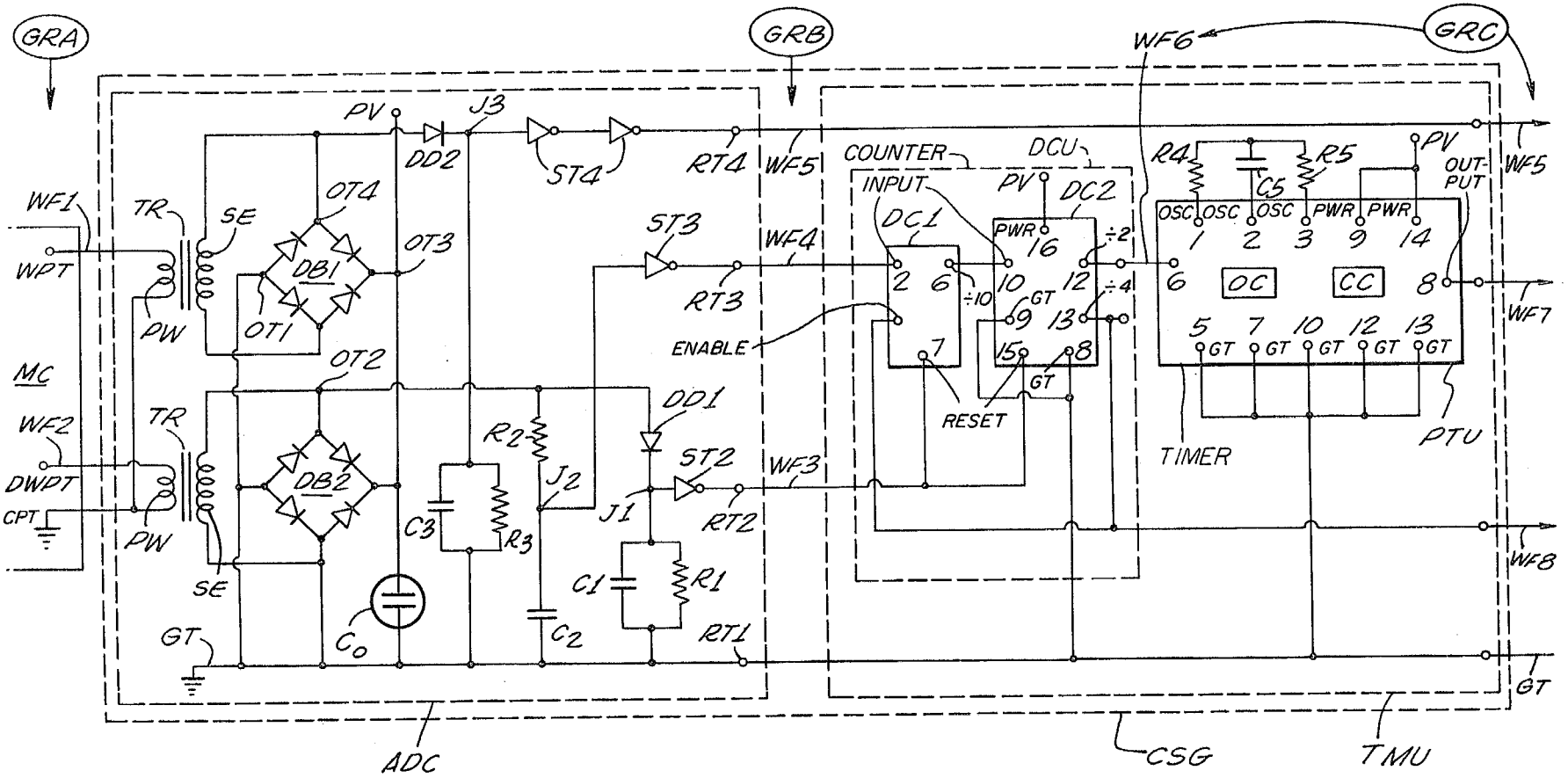
FIGS. 9A and 9B are to be combined to form a single drawing.
Figure 9B:
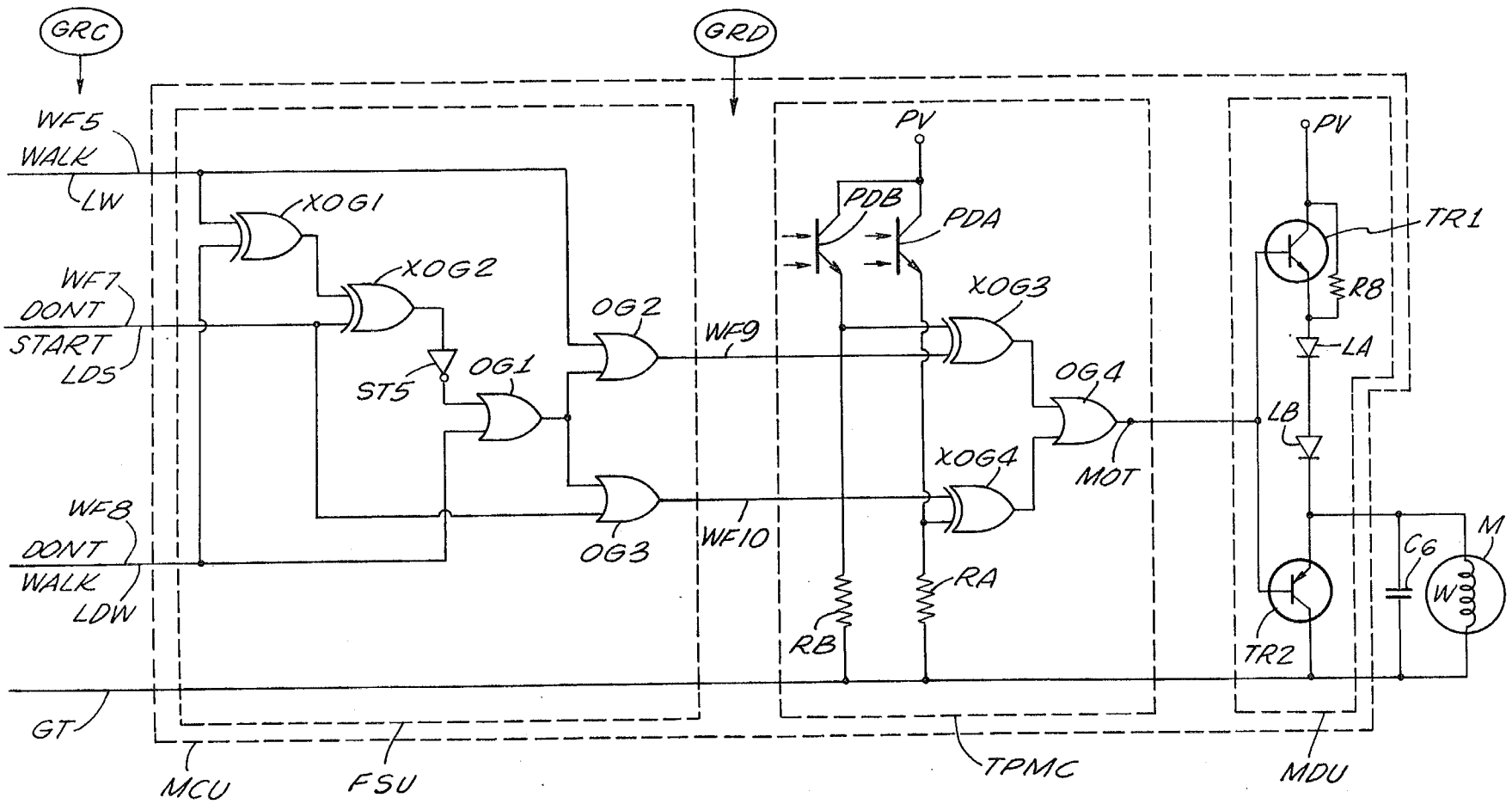

The pedestrian signal control unit PSCU comprises a control signal generator CSG and a motor control unit MCU, as shown in FIGS. 9A and 9B. The control signal generator CSG includes an AC/DC converter ADC, and a timer, or counter, unit TMU. The motor control unit includes a fail-safe unit FSU, a tape position matching circuit TPMC and a motor drive unit MDU. The AC/DC converter receives AC power from a three conductor supply at the output of the main controller MC. DC power developed by the AC/DC converter is applied at intervals by the motor control unit MCU to the DC motor M, which operates to drive the endless loop to any one of the three display conditions to display corresponding signs as commanded by the main controller. Such DC electric power is also supplied to the light-emitting diodes LA and LB and to the photosensors PDA and PDB in order to effect the desired positioning action of the endless loop.

More particularly, the main controller MC is provided with a grounded common line CL, a WALK power line WPL, and a DONT WALK power line DWPL connected respectively to the WALK power terminal WPT, a DONT WALK power terminal DWPT, and a common power terminal CPT. The AC power is supplied to primary winding PW of a pair of transformers TR, and the secondary windings SE of these transformers are connected to full-wave diode bridges DB1 and DB2 in order to provide rectified, or DC, power between the output power terminal PV and a ground terminal GT. A large capacitor $C_o$ is connected between the power terminal PV and the ground terminal GT, both to produce a steady DC voltage across the output terminals PV and GT, and also to store electrical energy for driving the endless loop to display the DONT WALK sign SS3 in the window WIN in the event that AC power fails while the DONT WALK sign is in some other position.

Figure 10:
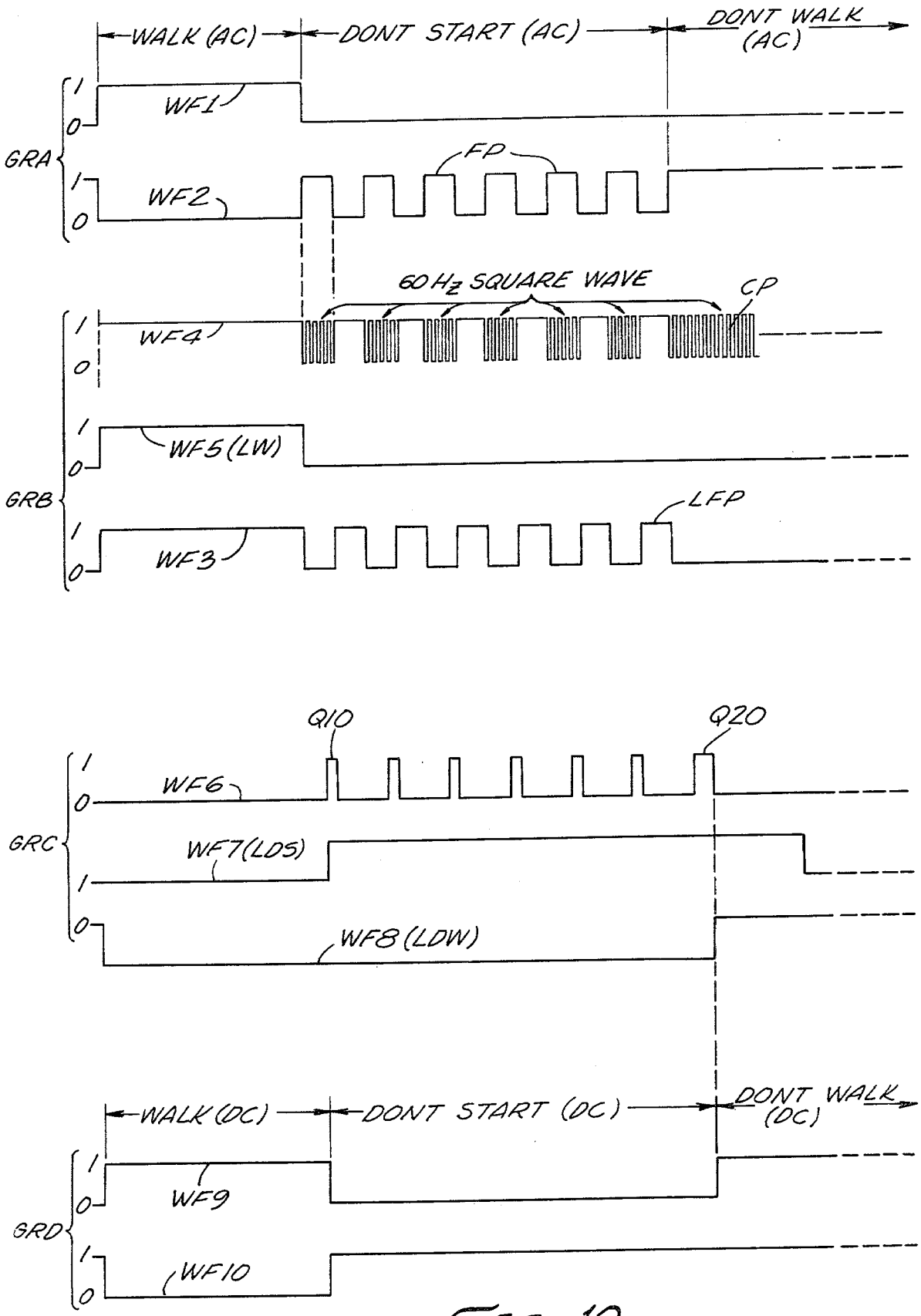
FIG. 10 is a series of graphs employed in explaining the operation of the invention.

The operation of the invention is explained herein with reference to four sets of graphs, namely, sets of graphs GRA, GRB, GRC, and GRD in FIG. 10. The set of graphs GRA represents events occurring at the output of the main controller unit MC and hence the input of the AC/DC converter ADC. The set of Graphs GRB represents events occurring at the output of the AC/DC converter ADC and the input of the timer, or counter, unit TMU. The set of graphs GRC represent events occurring at the output of the timer, or counter unit TMU and the input of the fail-safe unit FSU. The set of graphs GRD represent events occurring at the output of the fail-safe unit FSU and the input of the tape position matching circuit TPMC.

The signals vary in a controlled manner during three intervals designated in the graphs by the terms WALK, DONT START, and DONT WALK. The lengths of the intervals are determined manually by a policeman or other operator who sets controls in the main control unit MC.

The times of starting and stopping the WALK, DONT START, and DONT WALK signals are somewhat different between the output of the main controller MC where they are in AC form, and the output of the timer, or counter unit TMU, and the fail-safe unit FSU, where they are in DC form. The difference arises because of certain delay actions that occur in the timer unit TMU. Sometimes, therefore, a distinction is made between an AC and a DC signal and an AC and a DC interval. More particularly, the intervals during which the WALK, DONT START, and DONT WALK AC signals exist at the output of the main controller MC are sometimes referred to as AC intervals. The intervals during which the WALK, DONT START, and DONT WALK DC signals exist in the timer unit TMU and in the motor control unit MCU are sometimes referred to as DC intervals. The terms AC and DC are often omitted where it is believed that the meaning is clear from the context.

In conventional systems, neon lights which spell out the word WALK are energized continuously throughout the WALK interval, and neon lights which spell out the words DONT WALK are energized intermittently during the DONT START interval, and then continuously during the DONT WALK interval. A steady DONT WALK signal continues for a DONT WALK interval until the cycle of operation is reinitiated automatically as by traffic flow or by again pressing the pushbutton.

In the present invention, three printed signs namely the WALK, DONT START, and DONT WALK signs, are displayed in printed form on an endless belt during the three respective intervals in place of the lights. This is accomplished by operating an electric motor only during the short intervals during which the endless belt is being moved to change signs.

Referring now to FIG. 10, graphs GRA represent waveforms WF1 and WF2 appearing on lines so designated. These waveforms represent the three states of the AC power supplied by the main controller MC. The three states in question occur during the three successive intervals labeled "WALK", "DONT START", and "DONT WALK". The three states occur in succession, commencing at an initiation time after the pushbutton PB has been pushed by a pedestrian and the traffic signals VTL are operated to halt the flow of traffic on the street across which the pedestrian may walk when so signaled, as explained above.

The graphs of the waveforms WF1 and WF2 represent the envelopes, or amplitudes, or the alternating current that appears on the WALK power line WPL and the DONT WALK power line DWPL respectively. Thus, power is on the WPL line and is off on the DWPL line during the AC WALK interval. And during the AC DONT START interval, power is off the WALK power line WPL but is on and off intermittently on the DONT WALK power line DWPL. And finally, the power is off on the WALK power line WPL and is on on the DONT WALK power line DWPL during an indefinitely extended "DONT WALK" interval. These three pairs of on and off signals constitute three power states.

In traffic control signal systems that do not depend on the closing of a pushbutton switch, the AC DONT WALK interval is terminated and a new AC WALK interval is initiated automatically at regular intervals. In other systems that require manual actuation by the pedestrian, the DONT WALK interval continues indefinitely until the pushbutton is pushed again even though the main traffic control signals operate automatically under control of a manually set timer, or automatically in response to flow of traffic. In many systems, operation of the pushbutton PB prepares the main controller MC to initiate the operation of the pedestrian signal control unit PSCU the next time the traffic control signals VTL are set for the desired pedestrian crossing. And in some systems, the operation of the pushbutton operates the main controller to operate both the traffic control signals VTL and the pedestrian signal control unit.

In any event, the main control MC is set so that the AC power remains in the WALK state, and in the DONT START state for intervals which depend largely upon the width of the street to be crossed. Thus, the power remains in the WALK state for a period of at least 4 seconds and in the DONT START state for a period of at least 15 seconds for a street having a width of 60 feet, and then usually remains in the DONT WALK state for an indefinite period greater than the two previous intervals together. In the DONT START state, the power on the DONT WALK power line DWPL is turned on and off alternately once per second producing "flashing pulses" FP as indicated by waveform WF2.

The three AC power states may be in some other form, and indeed, as indicated by waveform WF2 only the DONT WALK power line and the common line need be employed so long as the power supplied for a complete cycle of operation occurs in three different states successively in the required order.

Control Signal Generator

The control signal generator CSG (FIG. 9A) converts the three-state AC power into three separate DC control signals, which are employed to actuate the motor control unit MCU to control the operation of the motor to position the WALK, the DONT START, and the DONT WALK signs successively in the window of the sign display units for suitable intervals. The circuits of the control signal generator CSG and the motor control unit MCU are all of the semiconductor type utilizing positive logic in which a high positive voltage represents a logic "1" signal, and low, or zero, voltage represents a logic "0" signal. Sometimes a signal applied to or generated by one of the circuit components is referred to as a logic "1" or a logic "0", without including the term signal.

In normal use, the AC power has an RMS voltage of about 115 volts, and a frequency of 60 Hz, and the transformers are adapted to produce power on the secondary windings of 10 volts RMS. The signals at the bridge terminals OT2 and OT4 are half-wave 60-cycle signals. The peak voltage at these terminals is about 16 volts. The voltage at the bridge terminal OT3 is DC and is also about 16 volts.

Three RC circuits interconnect the outputs of the rectifiers with first, second, third, and fourth output terminals RT1, RT2, RT3, and RT4 of the AC/DC converter ADC. The first terminal RT1 is connected to the ground terminal GT of the rectifiers DB1 and DB2.

A first RC circuit comprising a resistor R1 and capacitor C1 that are connected in parallel, are connected through a diode DD1 across terminal OT2 and the ground terminal GT. The second output terminal RT2 is connected through a Schmitt trigger circuit ST2 to the junction J1 between the first RC circuit and the diode DD1.

A second RC circuit comprising resistor R2 and capacitor C2 is arranged with resistor R2 and capacitor C2 connected in series across the bridge terminal OT2 and the ground terminal GT. The third output terminal RT3 is connected through a Schmitt trigger circuit ST3 to the junction J2 between the resistor R2 and the capacitor C2 of the second RC circuit.

A third RC circuit comprising a resistor R3 and capacitor C3 that are connected in parallel, is connected through a second diode DD2 across terminals OT4 and GT of the bridge circuit. The fourth output terminal RT4 is connected serially through two series-connected Schmitt trigger circuits ST4—ST4 to the junction J3 between the diode DD2 and the third RC circuit.

With this arrangement, three positive DC signals having waveforms WF3, WF4, and WF5 appear at the terminals RT2, RT3, and RT4, all the signals being measured relative to the voltage at the ground terminal RT1. These three DC signals actuate the counter and timer unit TMU.

In addition, a power terminal PV is connected to the bridge terminal OT3. A positive voltage of 15 volts appearing at this terminal is applied to various elements of the counter and timer unit TMU and the motor control unit MCU.

Suitable values of the various resistors and capacitors of the AC/DC converter are tabulated below:

CO=43,000 μF
C1=0.05 μF
C2=0.01 μF
C3=0.05 μF
R1=1 M
R2=47 K
R3=1 M

The diodes DD1 and DD2 both bear the designation Motorola Series 1N4148. These components, as well as all other Motorola components referred to herein, are available from Motorola Semiconductor Products, Inc., Austin, Tex.

The value of the capacitor $C_o$ is sufficiently great to provide steady DC power so long as AC power is applied across the diode bridges DB1 or DB2, and to store enough energy to operate the motor M for a period at least as long as one revolution of the loop EL when the AC power is turned off, or fails.

The R2, C2 circuit and the Schmitt trigger circuit ST3 act to provide 60 Hz square waves at the output terminal RT3 when AC power is present at the DONT WALK terminal DWPT and is positive at other times. This signal is represented by graph WF4 of FIG. 10.

The DC DONT WALK signal WF3 is the inverse of the AC DONT WALK signal WF2, being high (positive) during the WALK interval, and high intermittently for one-half second at one second intervals during the DONT START interval, and low, or zero, during the DONT WALK interval. Thus, the voltage at the rectifier terminal RT2 is an intermittent one pulse per second signal that exists only during the DONT START period. This signal is low, or off, when the amplitude of the DONT WALK signal is high and it is high, or on, when the amplitude of the DONT WALK signal is low.

The graph WF5 represents the signal that appears at output terminal RT4. This signal WF5 is a replica of the envelope of the WALK power signal represented by the graph WF1, but is a DC signal instead of an AC signal. This DC signal has a high positive voltage throughout the WALK interval, and a low, or zero, voltage at all other times.

The signals developed at the output terminals RT2, RT3, and RT4 operate the control and timer unit TMU to produce signals represented by graphs WF7 and WF8 that coact with the signal WF5 to achieve the desired control of the motor M and hence the desired positioning of the endless loop.

The timing unit TMU includes a dual counter unit DCU comprising two tandem-connected decade counters DC1, DC2 and a programmed oscillator timer unit PTU. The dual counters are in the form of a single integrated circuit unit, known as the Motorola Series MC14518B unit. Such units are described in general at pages 296–300 of the volume 5, Series B "Semiconductor Data Library/CMOS" published by Motorola in 1976. These particular counters operate on a BCD (binary-coded decimal) basis. The oscillator timer OT is designated as Motorola Series MC14541B unit. A diagram of such a unit and its characteristics are set forth at pages 385 to 390 of volume 5, Series B of the "Semiconductor Data Library/CMOS" (Motorola Inc., 1976).

The ground terminal GT and hence output terminal RT1 are connected to pins 8 and 9 of the second decade counter DC2. The output pin 6 of the first decade counter DC1 is connected to the input terminal 10 of the second decade counter DC2. The output pin 6 is a divide-by-10 terminal. The output pin 12 is a divide-by-2 terminal and the output pin 13 is a divide-by-4 terminal. Consequently, as viewed from the input pin 2, pin 12 acts as a divide-by-20 terminal and pin 13 acts as a divide-by-40 terminal. The output terminal 13, which acts as a divide-by-4 terminal, is connected to pin 1 of the first decade counter DC1. The outputs of the dual counter arrangement are generated at pins 12 and 13.

As dual counter unit DCU is purchased, either terminal 1 or 2 of the first counter DC1 may be used for counting. This is because either negative-going transitions applied to the enable pin 2 or positive-going transitions applied to the clock pin 1, will cause the counter to increment if it is enabled. Advantage is taken of this fact by applying an enabling signal to pin 1 to count pulses applied to pin 2. Positive-going transitions applied to pin 10 of the second counter DC2 cause it to count, when enabled.

Counting by the first counter is enabled when the signal applied to both pins 1 and 7 has a level of logic 0 and is inhibited when the signal applied to either or both of these pins has a level of logic 1. Thus, incrementing of the counter DC1 occurs only in response to the 60 Hz pulses applied to pin 2 from the output terminal RT3, and at that only when enable signals are applied to both terminals 1 and 7. 60-cycle bursts of such pulses are applied to pin 2 during the flashing interval and a steady stream of such signals during the DONT WALK interval.

The second counter DC2 counts pulses developed at the output of pin 6 of the first counter only while a 0-level enabling signal is applied to pin 15 from terminal RT2. Thus, counting occurs with the counters DC1 and DC2 only when the signal WF3 is in its logic 0 or low level condition and at that only if the enable signal applied to pin 1 is also in its logic 0, or low level, condition.

The two counters are set to a count of 0 by application of a reset signal having a value of logic 1 from the output terminal RT2 to the reset pins 7 and 15. Just prior to resetting, logic 0 signals appear at the output terminals 6 and 12 of the respective counters, even though non-0 counts may be stored in the counter registers at that time.

With this arrangement, the control signal WF3 from terminal RT2 inhibits counting while in a WALK condition and enables counting while in the DONT WALK condition, and in certain parts of the DONT START condition. When this control signal WF3 rises from logic 0 to logic 1, the outputs of the counters DC1 and DC2 at pins 6 and 12 are set to a low voltage, or logic 0, state and remain so set until after the value of the control signal WF3 returns to a logic 1 state and counting of a sufficient number of pulses occurs.

In other words, pulses of one cycle duration applied to the pin 2 of the first counter DC1 are counted only while counter DC1 is enabled by logic 0 signals applied to pin 1 and to pin 7, and pulses are counted by the second counter DC2 only while enabled by a logic 0 signal applied to pin 15. The first counter produces a logic 1 signal at the output terminal 6 each time ten such cycles have been counted. Each of the logic 1 signals appearing at the output pin 6 are applied to the pin 10 of the second counter DC2. These logic 1 signals are counted, producing a logic 1 signal at the output pin 12 every time twenty cycles have been counted and a logic 1 signal at the output pin 13 each time forty such cycles have been counted.

As a result of the combined action of the two decade counters so connected and operated, a train of pulses having the waveform WF6, as shown in graph GRC, is generated at the output terminal 12 of the second counter DC2.

More particularly, a pulse is produced at the output pin 12 of the second decade counter DC2 commencing at a time twenty cycles after the control signal WF3 appearing at the output terminal RT2 undergoes a negative transition.

Since only ten cycles remain in each burst that is applied during the AC DONT START interval, prior to inhibiting the first counter DC1 by changing the signal at pin 7 from logic 0 to logic 1, the pulses that appear at the output pin 12 are of 10 cycles duration for each such burst. But when the last flasher pulse of the signal WF3 changes from logic 1 to logic 0, counting of pulses continues beyond 10 cycles, since there is a steady flow of 60 cycle pulses to pin 2, as indicated at CP of waveform WF4 until forty pulses are accumulated in the counters DC1 and DC2. When forty pulses have accumulated the voltage at terminal 13 changes from logic 0 to logic 1. Since terminal 13 connects to terminal 1, counter DC1 is inhibited from further counting of pulses that are being applied to pin 2. The 10 cycle pulses Q10 (30–20) occur during the AC DONT START signal and the 20 cycle pulse Q20 (40–20) occurs during the initial part of the AC DONT WALK interval.

The 10-cycle pulses Q10 and the 20-cycle pulse Q20 that thus occur in response to AC control signals WF1 and WF2, form an intermittent, or pulsing, DC signal that is applied from output terminal 12 of the dual counter to the reset terminal 6 of the programmed oscillator timer PTU.

Now consider again a sequence of events in the dual counter unit DCU commencing from a DONT WALK condition. Prior to the time that the signal at the output of terminal RT2 changes from logic 0 to logic 1 the system has been standing in its quiescent or DONT WALK condition, the output signals at pins 6, 12, and 13 all stand in their stable state and there they remain until a 60 Hz signal appears at terminal RT3 again during the next AC flashing interval. Thereafter, the pulses are counted by the respective counters as described above. Since the signal at the output terminal 13 of the second counter DC2 is in a logic 1 state, the first counter remains inhibited until a logic 0 signal is applied to pin 1 of the first counter DC1. Thus, the first counter remains inhibited until both counters are reset by a change in the level of the signal applied to pin 7 from logic 0 to logic 1, that is, at the time of initiation of the WALK interval and at the end of each burst of 60 Hz pulses and remains enabled until the next time that the signal at the terminal RT2 falls from logic 1 to logic 0.

During the flashing interval, the signal at the output terminal RT2 changes from logic 1 to logic 0, or vice versa, every half second. Each time the output signal WF3 goes from logic 1 to logic 0 at one second intervals, the counters are set in their counting condition and there they remain for one-half second. During that time, the first counter DC1 can count up to 30 cycles in every other half cycle of the flashing interval. After twenty such 60 Hz pulses have been counted, the output at pin 12 becomes a logic 1 and remains there until the counters are reset to 0 at the time of occurrence of the next posible transition of the reset signal from terminal RT2. It is to be noted that since only 30 pulses are counted by the first counter DC1 during each burst, the level of the signal at terminal 13 of the second counter DC2 remains at logic 0 during the entire flashing interval. In other words, in the first half of each half-second flashing interval, a pulse of 10 cycles duration is developed at pin 12 as indicated by graph WF6.

But when the last negative transition occcurs at output terminal RT2 during a flashing interval, pulses applied to terminal 2 are counted until 40 pulses have been counted and the signal at the output terminal 13 changes from logic 0 to logic 1 thereby applying an inhibiting signal to terminal 1. This causes the pulse Q20 of 20 cycles duration to appear at pin 12.

Programmed Oscillator Timer Unit

The ground terminal GT is connected to pins 5, 7, 10, 12, and 13.

The signal WF6 developed at the output terminal 12 of the dual counter operates the programmed timer unit PTU to produce DC control signals WF7 and WF8, and thus complete the final set of DC control signals WF5, WF7, and WF8 that operates the motor control unit MCU.

The programmed oscillator timer unit PTU includes an internal oscillator circuit OC and a counter circuit CC that are employed for switching the logic state at its output terminal 8 after a predetermined number of pulses have been counted after the counter has been triggered.

The frequency of oscillation of the oscillator component is determined by resistors R4 and R5 and capacitor C5. These elements form components of the oscillator and determine the frequency of oscillation. A typical value for this frequency is about 6,000 Hz. The triggering of the programmable timer unit PTU is accomplished by application of the control signal WF6 generated at the output pin 12 of the second digital counter DC2. The counter is designed to change the signal at its output terminal from a level of logic 0 to logic 1 after 8192 pulses have been counted.

Since the programmable timer unit is reset automatically once each second while the flashing pulses are applied and the oscillator frequency is 6,000 Hz, a count of 8192 is never reached during the DONT START period.

The signal at the output terminal 8 normally dwells at logic 0. When the first 10 cycle pulse Q10 is applied to the terminal 6 of the timer unit PTU, the timer unit is reset, causing the signal at its output pin 8 to rise to logic 1. If no change were to occur at the reset terminal 6, the internal counter would count the pulses from the oscillator OC until a count of 8192 is reached, at which time the signal at the output pin 8 would be reduced to logic 0 and there it would remain indefinitely. But since, as mentioned above, 10-cycle pulses are applied to the terminal 6 once each second during the AC DONT START interval, the internal counter never attains a count of 8192 but is repeatedly reset to a 0 count once each second during that interval. The signal at the output pin 8 remains at logic 1 until the 20-cycle pulse Q20 has been applied and has terminated, and the internal counter is allowed to continue to count until a count of 8192 is reached. This occurs a little more than a second after the last flashing pulse has terminated, that is, about one second after the AC DONT WALK interval has been initiated.

Thus, the signal appearing at the output of the terminal 8 therefore is a steady DC DONT START signal having a value of logic 1 represented by graph WF7.

Summarizing, it is observed that power signals WF1 and WF2 which are present in three different states at successive times, are first converted to three DC signals WF3, WF4, and WF5. Two of the signals WF3 and WF4 are employed for controlling the timer unit TMU which develops a DC DONT START signal WF7 and a DC DONT WALK signal WF8. The other DC signal WF5 generated by the AC/DC converter at terminal RT4, serves as a DC WALK signal. The DC WALK signal, the DC DONT START signal, and the DC DONT WALK signal are employed to control the operation of the motor and hence the positioning of the endless loop.

The control of the endless loop by the control signals WF5, WF7, and WF8 is attained through the action of a motor control unit MCU and a motor drive circuit MDU. The motor control unit includes a tape position control signal generator, sometimes referred to as a fail-safe unit FSU, and a tape position matching circuit TPMC.

Motor Drive Unit

The motor drive circuit MDC includes transistor TR1, first and second light-emitter diodes LA and LB respectively, and second transistor TR2 connected in series in the order named between the positive voltage terminal PV and ground GT. The two transistors form a complementary pair with their emitters connected to the light-emitting diodes and with their collectors connected to the positive voltage terminal PV and the ground terminal GT respectively. The first transistor is one of Motorola Series 2N3904 and the second transistor Motorola 2N3906 elements. The bases of the two transistors are connected to the output terminal MOT of the tape position matching circuit TPMC and are switched by a logic signal developed at that terminal MOT.

The winding W of the motor M is connected in parallel across the collector and the emitter of the second transistor TR2. A capacitor C6 shunts the motor winding W to reduce brush noise. A shunt resistor R8 is connected across the collector and the emitter of the first transistor TR1. For best effects, the resistor R8 and the motor M have equal resistance.

When the matching signal MOT at the output of the matching circuit TPMC has a logic 0 value, the second transistor TR2 conducts thereby permitting most of the current to flow through it and none, that is, very little, through the motor winding W. Simultaneously, the transistor TR1 is back-biased, thus rendering it non-conductive but forcing the current to flow through the shunt resistor R8 and through the two light-emitting diodes LA and LB.

When the matching signal MOT has a value of logic 1 the second transistor TR2 is rendered non-conductive causing any current flowing through the motor drive circuit MDU to flow through the winding W. At the same time, the first transistor TR1 is rendered conductive so that current can flow through this transistor instead of through the shunt resistor R8.

Thus, when the matching signal has a logic value of 0, the motor is deenergized, that is, shut off. But when the matching signal has a value of logic 1, current flows through the motor winding energizing, or turning on, the motor. In either event, so long as power is applied to the high voltage terminal PV, current flows through the two light-emitting diodes LA and LB. Thus, the diodes LA and LB emit light as long as energy is supplied to the motor drive unit MDU, regardless of whether the motor is running or is at rest.

The Motor Control Unit

The three pedestrian control signals WF5, WF7, and WF8 developed by the control signal generator CSG are applied over three corresponding lines LW, LDS, and LDW to the motor control unit MCU, including a tape position signal generator FSU and a tape position matching circuit TPMC.

The tape position signal generator FSU, which also acts as a fail-safe logic circuit, comprises a pair of exclusive-OR gates XOG1 and XOG2 and an inverter that is in the form of a Schmitt trigger circuit ST5. The tape position signal generator FSU also includes three OR gates OG1, OG2, and OG3 connected as shown.

The output of the tape position signal generator FSU is supplied to the tape position matching circuit TPMC to energize the motor or not, depending upon whether or not a sign is to be moved into display position.

The WALK signal line LW is connected to one leg of the exclusive-OR gate XOG1 and is also connected to the upper leg of a second OR gate OG2. The DONT START signal line LDS is connected to the lower leg of the second exclusive-OR gate XOG2, and also to the lower leg of the OR gate OG3.

The output of the first exclusive-OR gate XOG1 is connected to the upper leg of the second exclusive-OR gate XOG2. The output of the second exclusive-OR gate OG2 is connected through the inverting Schmitt trigger circuit ST5, to the upper leg of the OR gate OG-1. The output of the OR gate OG1 is connected to the lower leg of OR gate OG2 and also to the upper leg of OR gate OG3.

The logic of the tape position signal generator FSU is such that:

1. When the signal WF8 on the DONT WALK line LDW has a value of logic 1, the signal at the outputs of both OR gates OG2 and OG3 also have a value of logic 1. This is the case regardless of what the logic levels are of the signals on the other two lines LW and LDS. This is because the DC DONT WALK signal is supplied to the OR gate OG1, the output of which in turn is applied to the upper leg of the OR gate OG3 and to the lower leg of the OR gate OG2. As will be seen, a pair of logic 1 signals at the outputs of the OR gates OG2 and OG3 forces the endless tape into a DONT WALK position.
2. When the WALK signal WF5 on the line LW has a value of logic 1 and the signals on the other lines have values of logic 0, the output signal of OR gate OG2 is logic 1 and the output signal of OR gate OG3 is logic 0. This is because the WALK signal is applied directly to the upper leg of OR gate OG2 and because, through the operation of the exclusive-OR gates OG1 and OG2 and the Schmitt trigger circuit ST5 and the OR gate OG1, the signals applied to the two legs of OR gate OG3 both have values of logic 0.
3. When the signal WF7 on the DONT START line LDS has a logic level of 1, and the signals on the other lines LW and LDW have values of logic 0, the output signal of OR gate OG2 is logic 0 and the output signal of OR gate OG3 is logic 1. This is because the DONT START signal is applied directly to the lower leg of OR gate OG3 and because, through the operation of the exclusive-OR gates XOG1 and XOG2 and the Schmitt trigger circuit ST5 and the OR gate OG1, the signals applied to the two legs of OR gate OG2 both have values of logic 0.

Referring to FIG. 10, it will be noted that while the WALK signal WF5 has a value of logic 1, the DONT START signal WF7 and the DONT WALK signal WF8 have a value of logic 0. It will also be noted that the DONT START signal WF7 has a value of logic 1 during a large portion of the period when the DONT WALK signal has a value of logic 0 and for a short period of about one second after the value of the DONT WALK signal has changed from logic 0 to logic 1. However, as explained above, a logic 1 value for the DONT WALK signal WF8 prevails over the values of either the WALK or DONT START signal.

The manner in which the levels of the signals at the outputs of the output OR gates OG2 and OG3 change in the normal sequence of events, is indicated by waveforms WF9 and WF10 of set GRD in FIG. 10.

Control Action

With the embodiment of the invention illustrated, the control signal generator CSG issues three types of command signals to the motor control unit MCU, namely, a DC WALK command control signal WF5, a DC DONT START command control signal WF7, and a DC DONT WALK command control signal WF8. When the WALK command control signal is issued, the motor M is energized to advance the WALK sign into display position if and only if the WALK marker, namely, the perforation PF1 is not located in holding position opposite the marker detector MDA. When the DONT START command control signal is issued, the motor M is energized to advance the DONT START sign into display position if and only if the DONT START marker, namely, the perforation PF2 is not located in holding position opposite the marker detector MDB. When the DONT WALK command control signal is issued, the motor M is energized to advance the DONT WALK sign into display position if and only if the DONT WALK marker, namely, the two perforations PF3 and PF4, are not located in holding position opposite the marker detectors MDA and MDB.

Fail-Safe Action

The control and sign display unit of this invention is also designed to display the DONT WALK signal whenever the power to the main controller fails.

When AC power is supplied to the main controller, an electric charge is stored in the energy storage capacitor $C_o$ of an amount sufficient to drive the endless loop into the DONT WALK display position whenever the power goes off.

The charging time of the circuit feeding the capacitor $C_o$ is small, being less than about 2 seconds, while the discharging time of the capacitor $C_o$ is about 6 seconds.

When the power fails, the signals at the terminals RT2 and RT3 are logic 1, and RT4 is logic 0, causing the output signals at OR gates OG2 and OG3 to go to logic 1, so that the tape position matching circuit TPMC drives the endless belt to its DONT WALK position or else retains it in that position if it is already there.

More particularly, when the AC power goes off, the energy stored in the capacitor $C_o$ continues to apply high voltage to the high voltage terminals PV of the various elements of the unit, including the Schmitt trigger circuits and the various OR gates and exclusive OR gates, the dual decade counter, the oscillator timer, the tape position matching unit, and the motor driver unit.

When power is lost, terminal RT2 is a logic 1 which resets the dual decade counters DC1 and DC2 to a count of 0, therefore forcing a logic 0 on terminal 12 of DC2. Terminal 6 of the oscillator timer unit PTU is a logic 0. The oscillator timer unit PTU counts 8192 pulses of the 6,000 Hz oscillator OC and at that time, terminal 8 of PTU becomes logic 0. Both legs of exclusive OR gate XOG1 are logic 0 causing the upper leg of exclusive OR gate XOG2 to be logic 0. The lower leg (WF7) of exclusive OR gate XOG2 is also logic 0. The output of exclusive OR gate XOG2 is logic 0. This causes the output of Schmitt trigger ST5 to be a logic 1. The logic 1 at the output of Schmitt trigger ST5 is applied through the OR gate OG1 and the OR gates OG2 and OG3 to apply two logic 1 signals to the exclusive-OR gates XOG3 and XOG4. Because the voltage is still applied to the tape position matching circuit TPMC and the motor drive circuit MDU, light continues to radiate from the light-emitting diodes LA and LB and to be detected by the photosensors PDA and PDB causing the motor to drive the endless loop to display the DONT WALK sign, unless the DONT WALK sign is already in display position. The total energy stored in the capacitor $C_o$ is sufficient, if needed, to drive the loop more than one complete revolution from end to end. When the loop reaches the DONT WALK condition it remains there, and the remaining energy still stored in the capacitor $C_o$ is dissipated gradually through the various components of the system.

Summary

It is thus seen that this invention provides a new pedestrian traffic control unit that is more economical to use than the unit now commonly used and which may be readily installed in present pedestrian traffic control systems at minimum cost, and which has important fail-safe qualities.

The invention has been described with reference to a three-state power system. Other three-state power systems may also be employed. It is to be borne in mind that the three-state power system that is described, in effect provides some power of some kind in all three states, but that there is a fourth state in which no power at all is supplied. In the embodiment of the invention described, the invention provides that the pedestrian traffic signal system will give a "DONT WALK" warning if the power system fails. This is accomplished by automatically restoring the "DONT WALK" sign to display position regardless of whether the signal system is in either the "WALK" or "DONT START" condition when the power failure occurs and by retaining the DONT WALK sign in display condition if it is in that condition at the time of power failure.

As indicated previously, three-state power may be supplied in other ways. It was mentioned particularly that the power on one of the lines, namely, the DONT WALK power line DWPL alone utilized power that had three states, namely, no power during the WALK state, flashing power during the DONT START state, and full power during the DONT WALK state. However, the use of this single line would not be sufficient for the purpose of this invention since the system may still provide a WALK signal if the power fails during the WALK interval. Accordingly, a three-line system is preferred, namely, one that corresponds to the WALK line WPL, a second that corresponds to the DONT WALK line DWPL, and a common, or ground, line CL. Even when using such two lines however, the power may be supplied in other ways which would establish three power states. This could be achieved by merely applying DC power at high level and low, or zero, level to each line, but timed in such a way that three combinations of power existed on the two lines to provide three power states. Actually, in such an arrangement, a fourth power state also exists in which no power is supplied on either line. Any three of these four power states may be employed in various forms of the invention.

It is therefore to be understood that the invention may be embodied in many other forms than that particularly described herein, all within the scope of the appended claims.

The invention claimed is:

1. A pedestrian traffic signal for displaying a traffic sign in a display position comprising:

an endless sign with indicia thereon;

support means to support the endless sign to place at least one of the indicia in the display position;

motion means connected to the endless sign and to a power supply to move the endless sign past the display position;

position detection means to detect the position of the indicia with respect to the display position; and control means responsive to the position detection means to control the motion means to place a desired indicia on the endless sign in the display position, the control means including a fail-safe means to detect failure of the power supply and in response thereto place a previously selected indicia in the display position.

2. A pedestrian traffic signal as in claim 1 wherein the position detection means includes position code means arranged to move synchronously with the endless sign corresponding to the indicia thereon, and detector means for supplying a signal to the control means in response to the position code means.

3. A pedestrian traffic signal as in claim 2 wherein the position code means includes at least one opening in the endless sign; and wherein the detector means includes a light source positioned to illuminate the position code means, and a photosensor disposed opposite the light source to detect passage of the at least one opening between the light source and the photosensor.

4. A pedestrian traffic signal as in claim 3 wherein the endless sign has indicia for DON'T WALK, WALK, and DON'T START, and the position code means includes at least one opening in the endless sign corresponding to each of the indicia.

5. A pedestrian traffic signal as in claim 1 wherein the endless sign is an endless belt, and the support means is at least one roller disposed across the width of the endless belt.

6. A pedestrian traffic control signal as in claim 5 wherein the endless belt has sprocket holes along its edges, at least one of the at least one roller has sprockets which engage the sprocket holes, and the motion means includes a motor for driving the at least one roller having sprockets to thereby advance the endless belt past the display position.

7. A pedestrian traffic signal as in claim 6 wherein the control means comprise a first circuit which receives external signals coded to reflect which of the indicia is to be placed in the display means, and a second circuit connected to the first circuit, which second circuit in response to the external signals energizes the motion means to rotate the at least one roller having sprockets to move the endless belt to place the desired indicia in the display window and to stop the motion means once the desired indicia is so placed.

8. A pedestrian traffic control signal as in claim 2 wherein the support means includes a structure for defining the display position, and the endless sign includes at least three separate positions thereon for being separately positioned opposite said display position for display of only one of said positions at a time.

9. A pedestrian traffic signal as in claim 8 wherein the position code means includes at least one opening for each of the indicia.

10. A pedestrian traffic signal as in claim 9 wherein the endless sign is a continuous belt having two edges and includes a series of sprocket holes along each edge.

11. A pedestrian traffic signal as in claim 10 wherein the position code means for a first indicia includes a first opening near one edge of the endless sign, the position code means for a second indicia includes a second opening near the other edge of the endless sign, and the position code means for a third indicia includes a single opening located near each edge of the endless sign.

12. A pedestrian traffic signal as in claim 1 wherein the fail-safe means includes power storage means connected to the motion means for applying power to the motion means to place the previously selected indicia in the display position.

13. In a pedestrian traffic signal control unit including a frame having a sign display window therein:

a unitary endless sign having three indicia thereon, namely, a WALK indicium, a DON'T START indicium, and a DON'T WALK indicium, said sign extending over at least half the width of the sign display window;

means supporting said endless sign on said frame for movement of said sign past said window for displaying said indicia one at a time through said window;

detector means on said frame; and coded control means arranged to move synchronously with said endless sign past said detecting means, said coded control means including three respective coded means corresponding respectively to said three indicia, each said coded control means being in position for detection by said detector means only when the corresponding indicium is located in said window;

a horizontal light shield extending transversely of said frame opposite the center of said display window; and means for supporting a tubular source of light between said light shield and said endless sign on the external side of said sign.

14. In a pedestrain traffic signal control system for use with a traffic controller that supplies power in a succession of three power states, namely, a WALK power state, a DON'T START power state, and a DON'T WALK power state:

an endless sign having three indicia thereon, namely, a WALK indicium, a DON'T START indicium, and a DON'T WALK indicium;

motor means for moving said sign past a display position in which only one of said indicia is displayed at a time;

coded marker means moving synchronously with said endless sign past a detecting position, said coded marker means including three respective coded means corresponding respectively to said three indicia, each said indicium being located in said display position only when the corresponding coded marker means is detected at the detecting position;

means responsive to detection of said coded marker means for generating a coded signal that indicates when an indicium corresponding to the detected coded marker means is in display position;

control means responsive to said detected coded signal and individual ones of said power state for operating said motor means to move said endless sign to a position in which the indicium corresponding to the current power state is positioned in display position and for stopping said motor means to halt the movement of said endless sign when said last-mentioned indicium corresponds to the current power state;

an energy storage device for storing energy supplied by said controller while such power is being supplied;

means for continuing to apply said stored energy to said motor means when the supply of power to said control system is discontinued; and means responsive to discontinuance of such supply of power for applying stored energy to said control means as power in a DON'T WALK state after said supply of power has been discontinued whereby said endless sign remains in a DON'T WALK position if already there and moves to a DON'T WALK position if not already there, at the time of discontinuance of said power.

15. A pedestrian traffic signal control system as in claim 14 wherein said storage device comprises an electrical capacitor that accumulates electric charge when power is supplied to the pedestrian traffic signal control system; and means for operatively connecting said capacitor to said motor means to apply said accumulated charge to said motor means when the supply of power to the pedestrian traffic signal control system is discontinued.

16. In a pedestrian traffic signal control system for use with a traffic controller that supplies AC power in a succession of three states, namely, an AC WALK state, an AC DON'T START state, and an AC DON'T WALK state, an endless sign having three indicia thereon, namely, a WALK indicium, a DON'T START indicium, and a DON'T WALK indicium;

DC motor means for moving said sign unidirectionally past a display position in which only one of said indicia is displayed at a time;

an AC/DC converter having an input connectable to said traffic controller to receive said AC power therefrom, said converter including means for converting said AC power into DC power having a succession of three states, namely, a DC WALK state, a DC DON'T START state, and a DC DON'T WALK state, corresponding respectively to said three AC power states;

coded control means synchronously movable with said endless sign past a detecting position, said coded control means including three respective coded means corresponding respectively to said three indicia, each said indicium being located in display position when the corresponding coded means is in detecting position;

means including detector means responsive to detection of said coded means for generating a coded signal that corresponds to an indicium in display position;

means controlled by said DC power and responsive to said coded signal and the current state of said DC power for activating said motor means to advance said endless sign to a position in which the indicium corresponding to the state of said DC power is positioned in display position and for halting the advancement of said sign when said last-mentioned indicium corresponds to the current state of said DC power;

an energy storage device for storing energy while said DC power is being supplied; and means controlled by discontinuance of the supply of AC power for applying stored energy to said controlled means as power in a DC DON'T WALK state after said supply of AC power has been discontinued whereby said endless sign remains in a DON'T WALK position if already there and moves to a DON'T WALK position if not already there, at the time of discontinuance.

17. A pedestrian traffic control system as in claim 16 energy storage device is an electrical capacitor connected to the AC/DC converter to receive and accumulate electric charge therefrom when DC power is being supplied thereby; and means for supplying said electric charge from said capacitor to said motor means temporarily when the supply of said DC power is discontinued.

18. A pedestrian traffic signal for displaying a traffic sign in a display position comprising:

an endless sign with indicia thereon and with at least one blank portion whereon no indicia appear;

support means to support the endless sign to place at least one of the indicia or the blank portion in the display position;

motion means connected to the endless sign and to a power supply to move the endless sign past the display position;

position detection means to detect the position of the endless sign with respect to the display position; and control means responsive to the position detection means to control the motion means to place a desired portion of the endless sign in the display position, the control means including a fail-safe means to detect failure of the power supply, and in response thereto, place the blank portion of the endless sign in the display position.

* * * * *